US006059122A

United States Patent [19]

Cartmell

[11] Patent Number: 6,059,122

[45] Date of Patent: May 9, 2000

[54] DISPLAY AND HOLDING APPARATUS FOR STUFFED TOYS

[76] Inventor: Steven D Cartmell, 2624 W. Ft. Worth Pl., Broken Arrow, Okla. 74012

[21] Appl. No.: 09/143,768

[22] Filed: Aug. 31, 1998

[51] Int. Cl.[7] ..... A47F 7/00

[52] U.S. Cl. ..... 211/13.1; 211/85.3; 211/113

[58] Field of Search ..... 211/85.2, 13.1, 211/113, 189, 85.3

[56] References Cited

U.S. PATENT DOCUMENTS

| | | | |
|---|---|---|---|
| D. 269,145 | 5/1983 | Druiz et al. | 211/85.2 X |
| D. 380,117 | 6/1997 | Smith | D6/571 |
| 3,081,881 | 3/1963 | Seeger | 211/85.3 |
| 3,339,745 | 9/1967 | Sugerman | 211/85.2 |
| 3,718,260 | 2/1973 | Sharp | 211/85.2 |
| 3,945,500 | 3/1976 | Meckstroth | 211/85.3 X |
| 4,416,493 | 11/1983 | Sumner | 312/245 |
| 4,721,212 | 1/1988 | Lowe . | |
| 4,874,100 | 10/1989 | Smagula | 211/113 X |
| 4,966,287 | 10/1990 | Snyder | 211/85.2 |
| 5,067,618 | 11/1991 | Johnson | 211/85.3 |
| 5,813,545 | 9/1998 | Greenberg | 211/13.1 |

*Primary Examiner*—Robert W Gibson, Jr.

[57] ABSTRACT

A thin, flat base (11) consisting of a sheet of material of any shape with multiple holes (14,15,16) for displaying and holding stuffed toys (20). The base (11), suspension holes (18), rod spacer mounts (26) and lean support bases (22) make up a display and holding apparatus (10,12) that can be suspended from the ceiling, mounted on a wall or door, or lean against a wall on furniture. This apparatus allows treasured stuffed toys to be displayed and at the same time provides a practical method of storage in a multiple choice of locations.

5 Claims, 3 Drawing Sheets

DISPLAY AND HOLDING APPARATUS FOR STUFFED TOYS

BACKGROUND

1. Field of Invention

This invention relates to the types of displays for retaining stuffed toys, specifically to an improved display that can be ceiling suspended, wall mounted, easel supported, or wall supported.

2. Description of Prior Art

Stuffed toys simulating dogs, cats and other types of creatures are very popular among children and adults. Some types and brands of stuffed toys have become collectible and considerably expensive. In many homes stuffed toys are displayed as if they were fine china or other types of expensive collectibles.

Also, multiple stuffed toys take up considerable space, and are hidden because they are stacked or placed in rows one behind the other. With multiple toys taking up space in closets, on floors, on walls (U.S. Pat. No. 4,416,493 to summer, Nov. 22, 1983 and patent des. 380,117 to smith, Jun. 24, 1997) and in cabinets, less space is left for more important items. With toys in these locations, it leaves less space for shoes, clothes, furniture, pictures and posters, and conventional collectibles. In addition, in some locations the visual appeasing effect of the toys cannot be enjoyed because they are concealed or covered, or appear cluttered.

Presently, there are few devices or apparatus' on the market that are used to display or hold stuffed toys. Of the ones that exist, none are designed to be used at multiple locations in a room such as the floor, ceiling, or wall. For example, wall mounted display cases such as 4,416,493 to summer, Nov. 22, 1983 can only be mounted on a wall. It cannot stand on the floor nor is designed to hang from the ceiling. Because it can only be mounted on the wall it limits wall space that could be used for pictures, posters, or wall mounted furniture.

Another example is a product called a toy chain (no patent number found) that is designed to hang from the ceiling. Again it can only be hung from the ceiling or wall and cannot stand on the floor. Also, some of the ways in which it can be hung does not allow each toy to be displayed by itself because the toys overlap one another. Also, with the toys overlapping they may appear cluttered. A toy net (no patent number found) also exists on the market but it can only be hung in a corner of a room near the ceiling and most of the toys in it can only be partially seen, if at all.

OBJECTS AND ADVANTAGES

Accordingly, there are several objects and advantages of my invention.

(a) It can be put in many different locations of a room.
(b) It can be suspended from the ceiling in the middle of a room, or close to a wall or corner.
(c) It can set on an easel.
(d) It can be leaned against the wall on top of furniture.
(e) It can be suspended in rooms with normal or high ceiling heights.
(f) It displays stuffed toys in such a way that all toys are seen.
(g) It displays stuffed toys in such a way that it appears neat and not cluttered.
(h) It is not permanently fixed. It can be moved from one location or position to another.
(i) It can hold different sizes of stuffed toys.

DRAWING FIGURES

FIG. 1 shows suspension strings for holding the apparatus from the ceiling.

REFERENCE NUMERALS IN DRAWINGS

Figure 1:
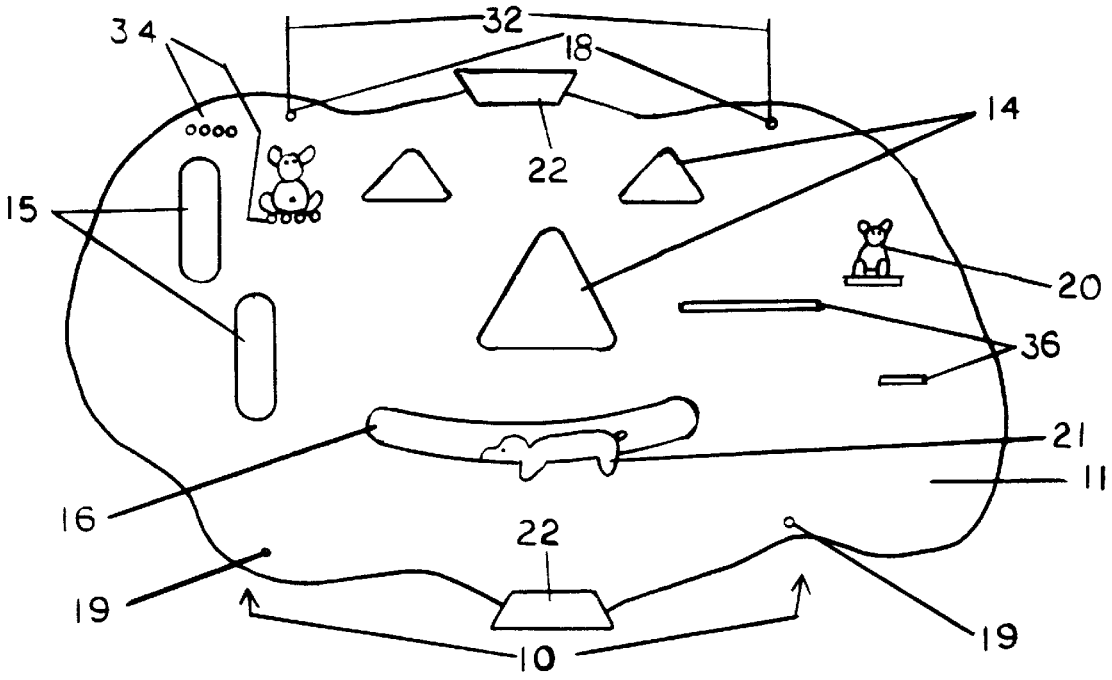
FIG. 1 shows the display and holding apparatus in the shape of a cloud with different shapes and sizes of holes along with shelves and dowels for holding stuffed toys. Also.

10 display and holding apparatus in the shape of a cloud
11 base of display and holding apparatus
12 display and holding apparatus in the shape of a flower
14 triangular hole
15 vertical elongated hole
16 horizontal elongated hole
18 holes for suspension strings or mounting screws
19 holes for mounting screws
20 stuffed toy (front exposed)
21 stuffed toy (side exposed)
22 lean support base
24 rounded base edge
26 rod spacer mounts
28 base slot
30 holes for screws
32 suspension string
34 holding dowels
36 shelf
38 top of furniture
40 wall

SUMMARY

In accordance with the present invention, a display and holding apparatus comprises a flat body of any design containing holes of any size and shape. Also, it contains holes for suspending or mounting it, hollow dowel rods for mounting to a wall or door, and lean support bases so that it can be leaned against a wall.

Description and Operation—FIGS. 1 to 4

Figure 2:
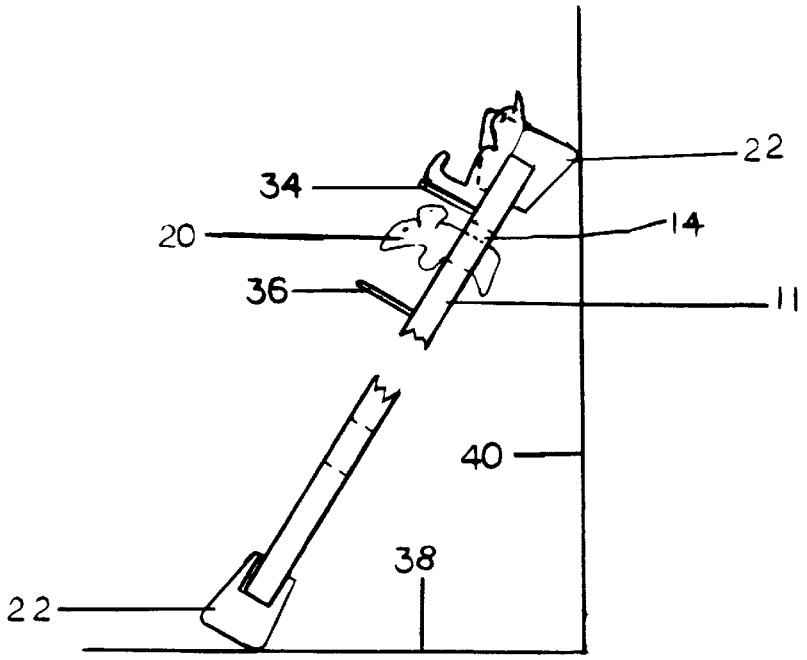
FIG. 2 shows a side view of the display and holding apparatus supporting a stuffed toy.

One embodiment of a display and holding apparatus 10 is illustrated in FIG. 1 (front view) and FIG. 2 (side view). It simulates the appearance of a cloud The apparatus 10 has a thin base 11 which may be of uniform cross section consisting of a rigid or flexible sheet of material. It is oval in shape with a fluted or undulating perimeter to simulate the shape of a cloud. The apparatus 10 contains holes 14, 15, 16 of different shapes and sizes for holding and displaying stuffed or soft toys 20. Each hole is designed to hold two or more toys. The toys 20 are simply pushed half way through the hole with approximately one half of the body in front and one half of the body in back and allowed to rest in that position. The elongated holes 15, 16 allow several toys to be placed side by side or on top of one another. Also, the horizontal elongated hole 16 allows toys 20 to be placed side ways so that the side of the toy can be seen. Also, a shelf 36 and holding dowels 34 are used to display stuffed toys. The apparatus 10 can be composed of one or a combination of many materials such as wood, plastic, styrofoam, metal or paper. In manufacturing it can be cut or molded. Also, it can be painted or laminated with paper or plastic, or if it is of a molded plastic, the plastic can be one or a combination of many colors or designs.

Figure 4:
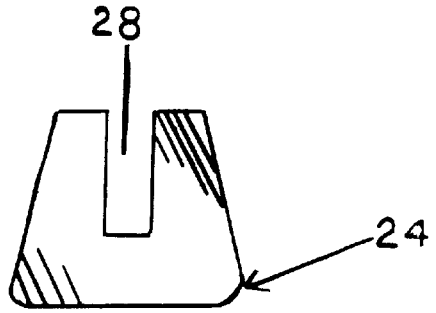
FIG. 4 shows a lean support base.

In FIG. 1, the apparatus 10 has suspension holes 18 for tying string or wires 32 to it so that the apparatus can be suspended from the ceiling or frame. Also, when preferred not to hang, apparatus 10, FIG. 1 and FIG. 2 show support bases 22 which are used to support the apparatus 10 when leaned against a wall on top of furniture. The lean support 22 bases allow the apparats 10 to be leaned against a wall or other type of vertical plane. With this combination it can be placed on furniture or other articles. Also, it can be easily moved from one place to another. The bases 22 can be composed of wood, plastic, metal, styrofoam, or paper. The bottom is flat and wide enough to prevent tipping of the apparatus 10. The top dimensions may be smaller than the base. Each support base 22 contains a vertical slot open at the top on each side which is at least two thirds the height of the base and wide enough to accommodate the thickness of the base 11. The preferred embodiment of the lean support base 22 is shown in FIG. 4. One support base 22 can be placed on the top center and one on the bottom center. The rounded edge helps prevent damage to any surface it may come in contact with.

Figure 3:
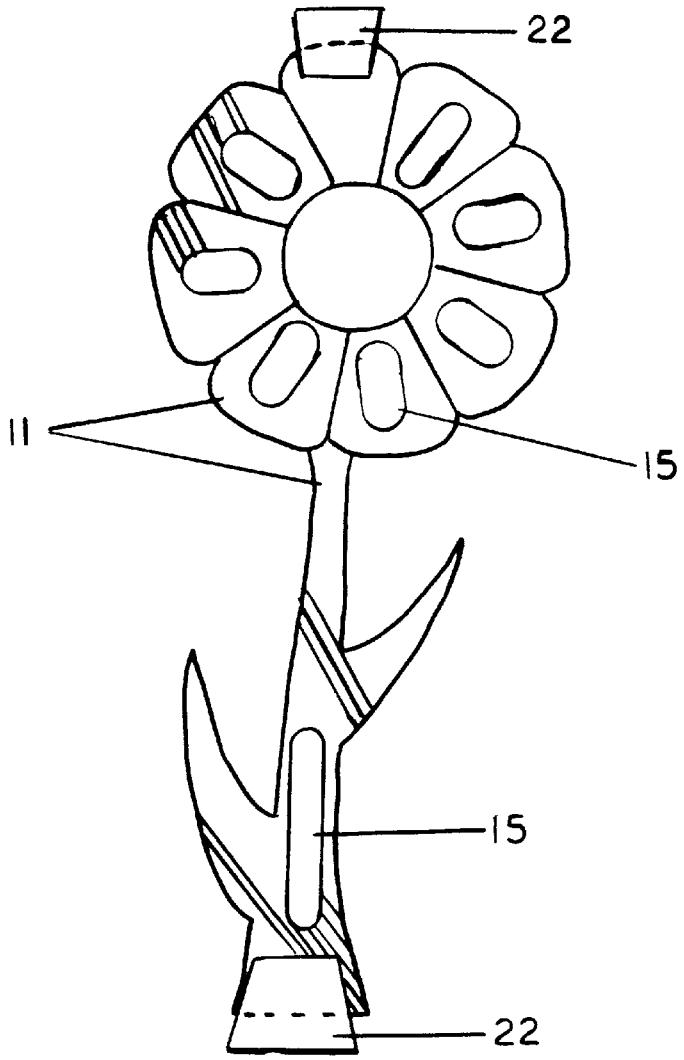
FIG. 3 shows the display and holding apparatus leaning against a wall on top of furniture supported by two lean support bases. The display is in the shape of a flower.

A second embodiment 12 of the display and holding apparatus is shown in FIG. 3 (front view). It simulates the appearance of a flower. The second embodiment demonstrates how the materials used to produce the 1st embodiment 10 can be used to produce the second embodiment, This fact reveals that any pattern, shape or design of a base can be used to create any style or configuration of a display and holding apparatus.

Figure 5:
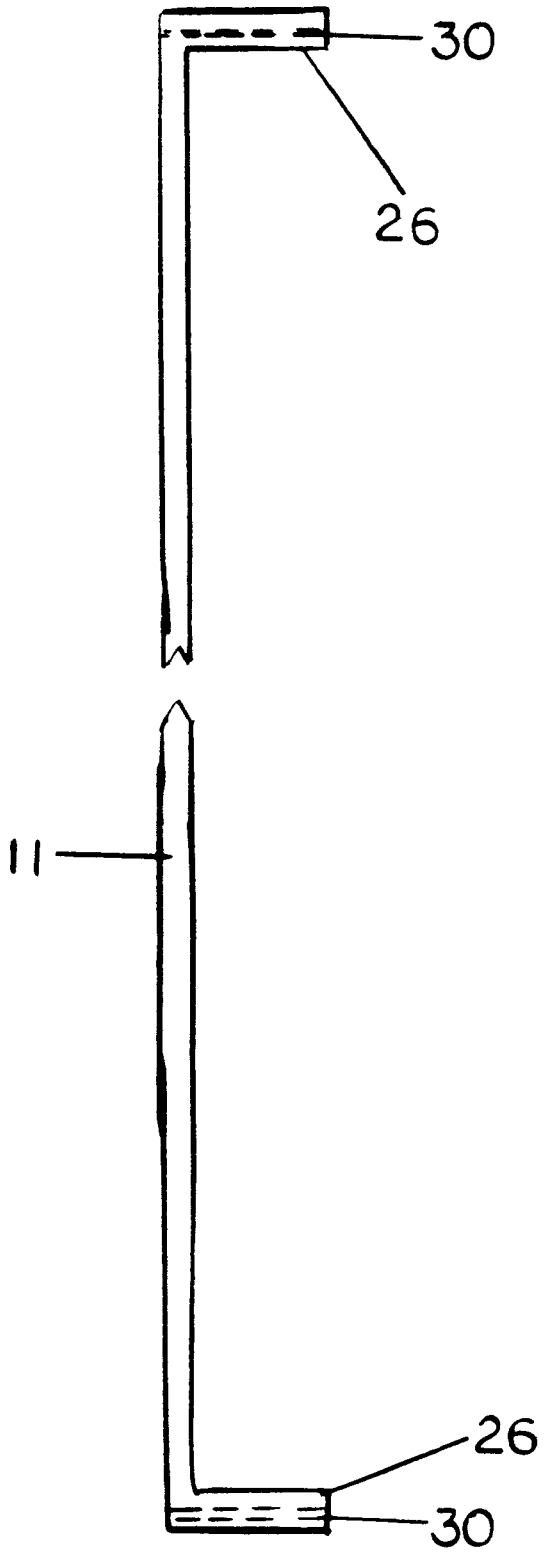
FIG. 5 shows a side view of the display and holding apparatus with hollow dowels attached for mounting to a wall and allowing space between the display and wall for the posterior portion of stuffed toys.

FIG. 5 demonstrates how hollow dowel rods 26 allow the display and holding apparatus to be mounted on the wall. The dowel rods 26 act as spacers to allow space for the posterior portion of stuffed toys between the display apparatus base and the wall. The display 10 is mounted by inserting screws from the from into the mounting holes 18, 19 through the hollow dowel rod and then into the wall.

SUMMARY, RAMIFICATIONS, AND SCOPE

Accordingly, the reader will see that multiple stuffed toys can be displayed, held, and organized with this invention. In addition, because the display and holding apparatus can be suspended from the ceiling or leaned against the wail, it can be put in many different locations to allow more space for furniture, posters, and pictures. Furthermore, the holding and display apparatus has additional advantages in that it can be set on an easel or lean against the wall with or without the use of the base supports;
it can be suspended in rooms with normal or high ceiling heights;
it can be mounted with the use of hollow dowel rods, brackets, or boards or any combination;
it displays stuffed toys in such a way they all can be seen;
it displays the toys in such a way that they appear neat and not cluttered;
it is not permanently fixed and can be moved to different locations;
it can hold different sizes of stuffed toys;
it can hold other types of toys;
it can be made in any shape, design or configuration;
it can be made of any type of material such as plastic, wood, cardboard, etc. and be of any thickness;
it can be any color or combination of colors;
it can be any size;
it can hold one or more stuffed toys;
it can be suspended with string, wire, or any other type of material that is suitable for this purpose;
it can be modular or in sections;
it could have square, rectangular, triangular or any shape of holes for holding and displaying stuffed toys;
it is economical to manufacture;
it could be of variable thickness;
it could have one design or drawing on one side and a different drawing or design on the other.
it could be used as a display in a home, office or store.

While my above description contains many specificities these should not be construed as limitations on the scope of the invention, but rather as an exemplification of one preferred embedment thereof. Many other variations are possible. For example, the sheet of material could be wavy or have ridges instead of being flat. Also it could have pegs in place of or in combination with holes, shelves, or dowels that hold the stuffed toys or any other article that can hang, sit or stand with the exception of women or men's apparel.

Accordingly, the scope of the invention should be determined by the embodiments illustrated, and by the appended claims and their legal equivalents.

I claim:

1. An apparatus for displaying and holding flexible toys, comprising:

a) a flat boy of material having a plurality of support means for supporting the toys for display;

b) suspension holes near the top and bottom of the flat body of material for the purpose of attaching said flat body to a ceiling or frame from above via stings or wire;

c) hollow dowel rods attached to said flat body which may be used to mount said flat body to a wall via screw which pass through the suspension holes, the said dowel rods, and into a wall to provide space for the posterior portion of a flexible toy between said flat body and said wall;

d) lean support bases attachable to the edges of said flat body of material which may be used to lean said flat body against a wall to provide support of said body and prevent scratches to the wall or furniture.

2. The apparatus of claim 1 wherein said flat body and its parts can be composed of wood, plastic, styrofoam, paper, glass, or metal.

3. The apparatus of claim 1 wherein said support means include a plurality of holes.

4. The apparatus of claim 1 wherein said support means include shelves.

5. The apparatus of claim 1 wherein said support means include dowels.

* * * * *